US007625203B2

(12) United States Patent
Mochizuki et al.

(10) Patent No.: US 7,625,203 B2
(45) Date of Patent: Dec. 1, 2009

(54) FOLDABLE IGNITER

(76) Inventors: Tetsuya Mochizuki, c/o Fuji Oyama Factory, Tokai Corp., 3-4 Shimohara, Subashiri, Oyama-cho Sunto-gun, Shizuoka 410-1431 (JP); Takayuki Suzuki, c/o Fuji Oyama Factory, Tokai Corp., 3-4 Shimohara, Subashiri, Oyama-cho Sunto-gun, Shizuoka 410-1431 (JP); Makoto Sato, c/o Fuji Oyama Factory, Tokai Corp., 3-4 Shimohara, Subashiri, Oyama-cho Sunto-gun, Shizuoka 410-1431 (JP)

( * ) Notice: Subject to any disclaimer, the term of this patent is extended or adjusted under 35 U.S.C. 154(b) by 0 days.

(21) Appl. No.: 12/065,144

(22) PCT Filed: Aug. 31, 2006

(86) PCT No.: PCT/IB2006/004138

§ 371 (c)(1),
(2), (4) Date: Mar. 18, 2008

(87) PCT Pub. No.: WO2007/099399

PCT Pub. Date: Sep. 7, 2007

(65) Prior Publication Data

US 2008/0220385 A1 Sep. 11, 2008

(30) Foreign Application Priority Data

Sep. 2, 2005 (JP) ..... 2005-254867

(51) Int. Cl.

| | |
|---|---|
| ***F23Q 3/01*** | (2006.01) |
| *F23Q 3/00* | (2006.01) |
| *F23Q 7/00* | (2006.01) |
| *F23Q 7/06* | (2006.01) |
| *F23Q 2/00* | (2006.01) |
| *F23Q 2/02* | (2006.01) |
| *F23Q 2/16* | (2006.01) |
| *F23Q 2/28* | (2006.01) |

(52) U.S. Cl. ..... 431/153; 431/253; 431/255; 431/258; 361/253; 361/258; 361/260

(58) Field of Classification Search ..... 431/153, 431/255, 258, 344, 345, 358; 30/38, 47, 30/155; *F23D 11/36; F23Q 2/28, 3/00, F23Q 3/01, 7/12; H01I 41/08*

See application file for complete search history.

(56) References Cited

U.S. PATENT DOCUMENTS 4,538,983 A 9/1985 Zeller et al.

(Continued)

FOREIGN PATENT DOCUMENTS

| | | |
|---|---|---|
| JP | H5-14172 | 2/1993 |
| JP | H9-133359 | 5/1998 |
| JP | 2007113912 A * | 5/2007 |

*Primary Examiner*—Steven B McAllister
*Assistant Examiner*—Daniel E Namay
(74) *Attorney, Agent, or Firm*—Trojan Law Offices

(57) ABSTRACT

A folding lighter that does not injure a finger or inadvertently ignite at pressing of the operating button at time of folding the swingarm to make the lighter compact. A folding lighter comprising body 2 housing a fuel tank 106 and a piezoelectric unit 102 and possessing on a side surface operating button 8, and swingarm 4 connected with free swinging to one end of body 2, and possessing a safety mechanism to prevent folding of swingarm 4 when foreign object 134 interposes between swingarm 4 and operating component 8 at time when swingarm 4 is being folded. The safety mechanism possesses swing preventer 120 that oscillatingly shifts by operation of operating component 8, and swing preventer 120 possesses first arm 121 that is pressed by pressing inward operation of operating component 8, and on the opposite side of axle socket 122 possesses second arm 123 that prevents swingarm 4 from being folded when first arm 121 is pressed by pressing inward operation of operating component 8.

2 Claims, 18 Drawing Sheets

U.S. PATENT DOCUMENTS 5,697,775 A * 12/1997 Saito et al. ..... 431/153
5,964,036 A * 10/1999 Centofante ..... 30/161
6,488,492 B2 * 12/2002 Adams et al. ..... 431/153
6,726,469 B2 * 4/2004 Adams et al. ..... 431/153
6,908,302 B2 * 6/2005 Sgroi et al. ..... 431/153
6,916,171 B2 * 7/2005 Adams et al. ..... 431/153
6,945,773 B2 * 9/2005 Adams et al. ..... 431/153
6,971,870 B2 * 12/2005 Sgroi et al. ..... 431/153
6,984,123 B2 * 1/2006 Adams et al. ..... 431/153
7,070,408 B2 * 7/2006 Sgroi et al. ..... 431/153
7,311,518 B2 * 12/2007 Sgroi et al. ..... 431/153
7,500,850 B1 * 3/2009 Fontaine ..... 431/253
2002/0055076 A1 * 5/2002 Adams et al. ..... 431/153
2002/0055077 A1 * 5/2002 Adams et al. ..... 431/255
2003/0208908 A1 * 11/2003 Kain et al. ..... 30/161
2004/0045171 A1 * 3/2004 Moizis ..... 30/161
2005/0155226 A1 * 7/2005 Van Deursen et al. ..... 30/152
2006/0073432 A1 * 4/2006 Frigiere et al. ..... 431/153
2007/0160945 A1 * 7/2007 Lin ..... 431/344
2008/0057454 A1 * 3/2008 Suzuki et al. ..... 431/153
2008/0070173 A1 * 3/2008 Sgroi et al. ..... 431/153

* cited by examiner

FOLDABLE IGNITER

PRIORITY CLAIM

The present application is a U.S. National Stage Application under 35 U.S.C. 371 of PCT/IB2006/004138, filed on Aug. 31, 2006, which claims priority to Japanese Patent Application 2005-254867, filed on Sep. 2, 2005.

FIELD OF THE INVENTION

This invention relates to lighters (igniter) that drive a piezoelectric unit by operation of an operating component and that emit a flame from the tip of a swingarm that extends from the body, and especially relates to folding lighters onto each of which is installed a swingarm with ability to swing to the lighter body.

BACKGROUND OF THE INVENTION

Formerly, lighters have been used for such as lighting gas burners and solid fuels and for igniting fireworks. As an example of such a lighter, a lighter having a tip pipe (extension) extended in a rod-shape from the body for emitting a flame is well known (Japanese Examined Patent H9-133359. This lighter possesses in its body a gas tank and a piezoelectric unit operated by an operating component, and by operating the operating component a flame is emitted from the tip of the tip pipe. Due to the separation of the tip of the tip pipe emitting the flame from the body held by the hand, a lighter of this form can safely and easily ignite objects without burning the user, but there is a problem in that comparatively more space is required to store the lighter due to lengthening of the lighter overall form.

To solve this problem, there are well known lighters that can be made compact by extending and collapsing from the body a rod-shaped extension for emitting the flame or can be folded when not in use. For example, a folding type lighter with a rod-shaped tip component installed with swinging enabled to one end of the body is known (Japanese Examined Patent H5-14172). This lighter normally retains the tip component (extension tube) in a folded and swing-enabled position against the body, and at time of use (time of igniting) allows utilization by extending from the body through swinging of the tip component. The operating component is installed on the body so as to be positioned between it and the folded tip component.

DESCRIPTION OF THE INVENTION

With the lighter disclosed in Patent Citation 2, there is a danger of injury to a finger or object by compression between the extension tube and the operating component at time of folding the extension tube, and there is danger of ignition by inadvertent pressing of the button.

This invention considers the above described concerns and has as its purpose the providing of a safe folding lighter that does not inflict injury or damage to a finger or object by compression between the swingarm and lighter body at time of folding the swingarm to make compact, and prevents at such time ignition by inadvertent pressing of the button.

The folding lighter of this invention is a folding lighter comprising a body that houses a fuel tank and a piezoelectric unit, and possesses at the side surface an operating component exposed to the outside for operating with approximate contemporaneousness the piezoelectric unit and a fuel supply valve that controls supply of fuel from the fuel tank, and a swingarm connected with free swinging to one end of the body, and housing a flame emission nozzle in the vicinity of the opposite end, and opening and closing freely between a housing position being folded against the side surface of the body and a utilizing position being opened at 90 degrees or more from the body, and housing in the body and the swingarm a flexible fuel conduit connected at one end to the fuel tank and connected at the opposite end to the flame emission nozzle, and characterized by further possessing a safety mechanism for preventing folding of the swingarm when a foreign object such as a finger interposes between the swingarm and the operating component at time when the swingarm is being folded to the housing position, with the safety mechanism possessing a swing preventer axially supported by a first axle socket within the body and that rotates corresponding to operation of the operating component, and with the swing preventer possessing a first arm projected to a position that intervenes within the movement range of the operating component to be depressed by a pressing inward operation of the operating component, and possesses on the side opposite of the first axle socket a second arm that prevents the swingarm from being folded as a section of the swingarm shifts within a range for shifting in response to folding movement of the swingarm, at time when the first arm is pressed by the pressing inward operation of the operating component.

In addition, the second arm can be structured to mate with a portion of the swingarm so as to push open the swingarm by additional pressing of the operating component when the operating component is further pressed from the position preventing its folding.

The folding lighter of this invention achieves the following effects because it possesses a safety mechanism for preventing the swingarm from being folded at the interposition of a foreign object such as a finger when the swingarm connected for free swinging to one end of the body is being folded to the stored position, with such safety mechanism possessing a first arm extending to a position that intervenes with the operating component and a second arm that prevents the swingarm from being folded when the first arm is pressed by the operating component.

Specifically, at folding of the swingarm, because the swing preventer prevents the swingarm from being folded if a finger or object is interposed between the swingarm and the push-button, there is no injury to the finger or damage to the object. In addition, because the swingarm cannot be folded, the push-button cannot be inadvertently pressed by a finger or object and therefore there is no danger of ignition.

In addition, when the second arm is structured to mate with one portion of the swingarm so as to push open the swingarm by the further pressing of the operating component at time when the operating component is pressed further from a position preventing the swingarm from being folded, even if a finger or object is relatively forcefully interposed between the swingarm and the body, there is enabled additional and reliable preventing of inadvertent ignition, and there is enabled reliable preventing of injury or damage to fingers or objects.

BEST MODE OF PRACTICING THE INVENTION

The following section references the attached drawings while describing in detail a preferred implementation form for the folding lighter (hereafter, simply referred to as lighter)

of this invention. FIG. 1 is a perspective drawing showing lighter 1 in the folded form. FIG. 2 is a perspective drawing showing lighter 1 in the form designed to enable use. As shown in FIGS. 1 and 2, lighter 1 possesses body 2 for grasping with a hand and swingarm 4 axially supported to swing freely at one end of body 2. Within body 2 are housed later described piezoelectric unit 102 (FIG. 8) and fuel tank 106 (FIG. 8). Swing-mount 6 is formed at one end of body 2, and swing-mount mate 10 is formed on one end of swingarm 4 and mounted to swing-mount 6 for support by swing-mount 6. Operating button 8 (operating component) is installed in body 2 to be exposed from opening 32 in the vicinity of swing-mount 6. Pressing this operating button 8 with a finger causes ignition.

In sidewall 14 of body 2 (FIG. 2), inspection window 12 is formed to enable checking of the remaining quantity of a fuel such as a liquefied gas. In addition, opening 18 is formed in body 2, from which protrudes adjustor protrusion 16 for adjusting the length of the flame to be emitted. In addition, pipe assembly 20 is housed in swingarm 4 with ability to slide in the lengthwise direction of swingarm 4. When swingarm 4 is in the closed position (housing position), specifically when it is folded to be overlapped by body 2 as shown in FIG. 1, pipe assembly 20 is in a condition pulled within swingarm 4. Conversely, when swingarm 4 is in the open position (utilizing position), specifically when it is opened to an angle of 90 degrees or more in relation to body 2 as shown in FIG. 2, tip tube 20*a* of pipe assembly 20 is in a condition projected from exposure port 60*b* of leading edge 4*a* of swingarm 4.

Body 2 possesses two reciprocally engaging components, specifically half-body 2*a* and half-body 2*b*,and it possesses full-body cover 2*c* that maintains the reciprocally combined condition of half-bodies 2*a* and 2*b*.The following section describes half-bodies 2*a* and 2*b* and full-body cover 2*c* by referencing FIGS. 3~5. FIG. 3 is a perspective drawing showing half-body 2*a* which is the forward facing half-body in FIGS. 1 and 2, with FIG. 3(*a*) displaying the half-body 2*a* shape as seen from the outside and FIG. 3(*b*) displaying the half-body 2*b* shape as seen from the inside. FIG. 4 shows half-body 2*b* which is the half-body opposite half-body 2*a* of FIG. 3, with FIG. 4(*a*) being a front view drawing as seen from the inside and FIG. 4(*b*) being a perspective drawing also as seen from the inside. FIG. 5 shows full-body cover 2*c*, with FIG. 5(*a*) being a perspective drawing and FIG. 5(*b*) being a perspective drawing displaying the cross-section along line 5*b*-5*b* of FIG. 5(*a*).

As shown in FIG. 3, half-body 2*a* is integrally formed from a synthetic resin, for example, and it possesses cylindrically shaped axle 6*a* (swing axle) structured as part of swing-mount 6. At cylindrically shaped surface 28*a* of axle 6*a*, the half-body possesses circular opening 24*a*, cylindrically shaped first axle socket 30*a* formed in succession with opening 24*a*, and annular wall (cylindrical wall) 26*a* formed at the outer side of first axle socket 30*a* and along the same axis as first axle socket 30*a*. In main section 22*a*, cutout 32*a* is formed to house the upper portion of operating button 8. Main section 22*a* possesses upper wall 34*a* and lower wall 36*a* extending approximately in parallel. At upper wall 34*a* and lower wall 36*a* flange sections 38*a* and 39*a* are integrally formed to extend on opposite sides of axle 6*a*. The outer surface of main section 22*a* is formed with channel 37*a* in a vertical direction for use in positioning full-body cover 2*c*. Furthermore, the vertical orientation shown here applies to the drawings referenced in the description.

This section describes in further detail axle 6*a* in reference to FIG. 3(*b*). At outer surface 31*a* of first axle socket 30*a* are formed two ribs, specifically stopping sections 40*a* and 41*a*, at a prescribed interval. In the inner direction of axle 6*a* and between outer peripheral surface 31*a* and each of stopping sections 40*a* and 41*a* are formed notches 42*a* and 43*a*. In addition, at the side of annular wall 26*a* toward main section 22*a*, cutout 44*a* is formed axially inward. Moreover, at the inner surface of main section 22*a*, protrusion 46*a* is formed to protrude inward in the vicinity of cutout 44*a*, and in a separated position at the opposite end of main section 22*a* from protrusion 46*a* is formed socket seat 50*a* possessing inward facing elliptical recess 48*a*. Socket seat 50*a* is the shaft receptacle for operating button 8.

This section describes the opposing half-body 2*b* by referencing FIG. 4. Half-body 2*b* is a shape approximately reflective of half-body 2*a*, and it possesses axle 6*b* and main section 22*b*. Axle 6*b* possesses annular wall (cylindrical wall) 26*b* of the same outer diameter as axle 6*a*. Stopping sections 40*b* and 41*b* are on outer peripheral surface 31*b* of first axle socket 30*b* and correspond to stopping sections 40*a* and 41*a*. Furthermore, mating section 40 is named to incorporate stopping sections 40*a* and 41*a* and stopper 41 is named to incorporate stopping sections 40*a* and 41*a*. In difference to first axle socket 3*a*, within the periphery of first axle socket 30*b* there are formed three reciprocally separated notches 30*c*, 30*d* and 30*e*. In main body 22*b*, cutout 32*b* is formed corresponding to cutout 3*a*. Moreover, cutouts 32*a* and 3*b* enable structuring of single opening 32 for receiving operating button 8 at time of unifying main sections 22*a* and 22*b* (FIGS. 1 and 2). Below cutout 32*b*, protrusion 46*b* and socket seat 50*b* are respectively identical to and corresponding to previously described protrusion 46*a* and socket seat 50*a*. In upper wall 34*b* and lower wall 36*b* of main section 22*b* are formed flange sections 38*b* and 39*b* in positions corresponding to previously described flange sections 38*a* and 39*a*. Furthermore, second axle socket 50 is named to incorporate socket seat 50*a* and socket seat 50*b*. Support sections 38 and 39 are named to incorporate respectively flange sections 38*a* and 39*b* and flange sections 39*a* and 39*b*. Moreover, channel 37*b* is formed in main section 22*b* of half-body 2*b* corresponding to channel 37*a*.

This section describes full-body cover 2*c* by referencing FIG. 5. Full-body cover 2*c* is used by first reciprocally mating the inner surfaces of previously described half-bodies 2*a* and 2*b* and then fitting full-body cover 2*c* over half-bodies 2*a* and 2*b* from the opposite end of the combined half-bodies 2*a* and 2*b*. Full-body cover 2*c* possesses opening 54 formed by the pair of edges 52 and 52 curved upward at one end. As shown in FIG. 5(*b*), within full-body cover 2*c* are disposed to protrude ribs 56*a*, 56*b* and 56*c* for positioning previously described piezoelectric unit 102 and fuel tank 106 at time of housing (FIG. 8). Rib 56*a* is formed as a pair of ribs at left and right in the lengthwise direction of full-body cover 2*c*, and similarly rib 56*b* is formed as a pair of ribs at top and bottom in the lengthwise direction (FIG. 8). Furthermore, respective opposite side ribs 56*a*, 56*b* and 56*c* are not shown in FIG. 5(*b*). Rib 56*c* is formed vertically at the furthest inner section. In addition, at each inner surface of sidewalls 14, bead 58 is formed for mating respectively to channels 37*a* and 37*b* of half-bodies 2*a* and 2*b* at time of receiving previously described half-bodies 2*a* and 2*b*. Bead 58 is shown for only one side in FIG. 5. By mating beads 58 to channels 37*a* and 37*b*, full-body cover 2*c* is positioned and also fixed.

This section describes in detail swingarm 4 mounted for swinging to body 2 structured of half-bodies 2*a* and 2*b* and full-body cover 2*c* as explained above. FIG. 6 shows swingarm 4, with FIG. 6(*a*) being a perspective drawing and FIG. 6(*b*) being a front view drawing. Swingarm 4 possesses swing-mount mate 10 and long protective cover 60 integrally formed to swing-mount mate 10. Protective cover 60 possesses cavity 62 passing through the lengthwise direction within protective cover 60. Protective cover 60 is maintained to allow swinging of swingarm 4 without touching tip tube 20*a* of pipe assembly 20. Swing-mount mate 10 is mounted for swinging by interposition support with free swinging between axles 6*a* and 6*b* of half-bodies 2*a* and 2*b*. Swing-mount mate 10 possesses annular wall (cylindrical wall) 26*c* of approximately the same outer diameter as axles 6*a* and 6*b*. At annular wall 26*c*, annular step 64 is formed for crowning of annular walls 26*a* and 26*b* of body 2. Furthermore, at annular wall 26*c* and annular step 64, opening 66 is formed is formed for passage between the interior of annular wall 26*c* and cavity 62 of protective cover 60.

Within annular wall 26*c*, arching inner wall (outer cylinder) 70 is integrally supported on the same axis as annular wall 26*c* by three support walls 68*a*, 68*b* and 68*c* reciprocally separated in the circumferential direction. A cylindrical space is formed between arching inner wall 70 and annular wall 26*c*. Support walls 68*a* and 68*c* are positioned symmetrically to bind the center arching inner wall 70, and support walls 68*b* is positioned at the lower end of arching inner wall 70 midway between and 68*c*. Furthermore, previously described first axle sockets 30*a* and 30*b* are named the inner cylinder in relation to the outer cylinder. The upper portion of arching inner wall 70 is a cutout form that specifically becomes opening 66.

At arching inner wall 70, two protrusion sections 72*a* and 72*b* are formed to protrude facing the body 2 side. Protrusion section 72*a* is formed in the lower section vicinity of support wall 68*a* and protrusion section 72*b* is formed in a position approximately identical to that of support wall 68*c*. Swelled protrusions 73 are formed on the leading edges of these protrusion sections 72*a* and 72*b* facing inward. At assembly of swingarm 4 and body 2, these swelled protrusions 73 mate at three prescribed angles with notches 30*c*, 30*d* and 30*e* of first axle socket 30*b* of body 2. Specifically, at swingarm 4 operation, this imparts a clicking sensation at the swingarm 4 folded position, the opened utilization position, and a midpoint position. In this way, for lighter 1 in any of various positions or attitudes, there is enabled stable utilization and prevention of swingarm 4 position changes from these prescribed angles.

In addition, as shown in FIG. 6, at the lower side of annular wall 26*c*, specifically at support wall 68*b*, protrusion (thick section) 74 is formed. Protrusion 74 is formed along the edge at the body 2*b* side of annular wall 26*c* and extends from the lower end of annular wall 26*c* in both directions toward support wall 68*a* and support wall 68*c*. Protrusion 74 extends slightly toward support wall 68*a* and extends more than half the distance along the circumference for support walls 68*b* and 68*c*. In addition, arching inner wall 70 is established with rib 76 protruding at a position approximately identical to that of support wall 68. Furthermore, arching inner wall 70 is formed with slot 78 directly below rib 76.

Protective cover 60 possesses metal cap 60*a* having exposure port 60*b*. By using latching hooks not shown in the drawing, for example, cap 60*a* is mated and latched to a recess or hole (not shown in drawing) established in protective cover 60. Furthermore, it is acceptable to use a thermally insulating material such as nylon for cap 60*a*.

This section describes pipe assembly 20 by referencing FIG. 7, with FIG. 7(*a*) being a perspective drawing and FIG. 7(*b*) being a component cross section drawing of the region shown by circle 7*b* in FIG. 7(*a*), and both showing the condition in which the gas pipe of the nozzle is inserted into pipe assembly 20. Pipe assembly 20 possesses tip tube 20*a* and tip pipe 20*b* on which tip tube 20*a* is installed. Tip tube 20*a* is of cylindrical shape, and it possesses flame port 82 for emitting a flame from the tip. Tip pipe 20*b* is formed of a synthetic resin, for example, and it possesses plate-shaped extension 86 integrally formed to cylinder 84 onto which is installed leading edge tube 20*a*. The tip of extension 8, specifically the end facing the body, is formed in a T-shape. Specifically, cylindrical protrusion 88 projects in opposing directions perpendicular to the lengthwise direction of pipe assembly 20 and to channels at both sides. As shown in FIG. 7(*b*), nozzle holder 90 is formed to pass through cylinder 84 in tip pipe 20*b* and to be stored within tip tube 20*a*. At tip tube 20*a* possessing cylinder 84 and nozzle holder 90, space 92 is formed in the lengthwise direction of tip tube 20*a*. In this space 92 is disposed nozzle (flame emitting nozzle) 94 and gas pipe 96 linked to nozzle 94.

Nozzle 94 possesses nozzle tip 94*a* and nozzle body 94*b* into the tip of which is inserted nozzle tip 94*a*. This nozzle 94 is fixed to the leading edge of nozzle holder 90 so that nozzle tip 94*a* is at the outer side of nozzle holder 90. Gas pipe (flexible fuel conduit) 96 is linked by linking pipe 98 to nozzle body 94*b* of nozzle 94. Nozzle cover 100 is installed at the outer side leading edge of nozzle holder 90 to protect nozzle tip 94*a*.

This section describes in further detail lighter 1 by referencing FIGS. 8 and 9. FIG. 8 is a cross section drawing along line 8-8 of lighter 1 shown in FIG. 1, and FIG. 9 is a cross section drawing along line 9-9 of lighter 1 shown in FIG. 1. As shown in FIG. 8, swingarm 4 is overlapping body 2 in the closed condition, specifically the folded condition. Within body 2 is disposed piezoelectric unit 102, housing 104 maintaining piezoelectric unit 102, and fuel tank 106. Piezoelectric unit 102 possesses sliding component 102*a* that is pressed for piezoelectric unit 102 to generate electricity. Fuel tank 106 is a cylindrically square component structured to be installed and fixed in housing 104 on the opposite side of piezoelectric unit 102. Piezoelectric unit 102 and fuel tank 106 are positioned and retained by previously described ribs 56*a*, 56*b* and 56*c* as well as support sections 38 and 39. In addition, operating button 8 of body 2 is axially supported for free swinging by second axle socket 50 so as to face opening 32 of body 2.

This section describes operating button 8 by additionally referencing FIG. 10. FIG. 10 shows operating button 8, with FIG. 10(*a*) being a perspective drawing, FIG. 10(*b*) being a top view drawing, FIG. 10(*c*) being a side view drawing, and FIG. 10(*d*) being a front view drawing. Operating button 8 possesses upper wall 108 that in a top view is of transforming shape from circular to elliptical by forming a large arching shape on one side and small arching shape on the other side. The circumference of upper wall 108 is encompassed by peripheral wall 110, and the inner side of peripheral wall 110 becomes a cavity. Within peripheral wall 110, plate 8*a* is disposed to project to the side direction, and one side of plate 8*a*, specifically toward the half-body 2*b* side, L-shaped mating hook (hook component) 8*b* is formed to extend with upward inclination. At the leading edge of mating hook 8*b*, protrusion 112 is formed facing inward.

Plate 8*a* contacts against the lower edge of one side of opening 32 of body 2 with operating button 8 under the opening. In this way, operating button 8 does not dislodge outward from opening 32. In addition, at the other side of peripheral wall 110, the pair of cylindrical shafts 8*c* used for axle support from second axle socket 50 are disposed projecting to a position corresponding to axle socket 50. Moreover, as shown in FIG. 8, arm 8*e* is integrally fixed downward from the other side of upper wall 108. At the lower side of this arm 8*e*, curved protrusion 116 is formed to face sliding component 102*a*.

When operating button 8 is axially supported by second axle socket 50, previously described mating hook 8*b* is positioned at swing-mount 6. In addition, curved protrusion 116 of arm 8*e* is positioned to contact sliding component 102*a* or the vicinity thereof, with sliding component 102*a* in a condition being projected by outward biasing of a spring. Moreover, shaft 8*c* is axially supported with play in elliptically shaped second axle socket 50, and it is in a condition enabling movement in a horizontal direction to the opposite side. It is clear that at swing-mount 6, circular first axle sockets 30*a* and 30*b* of half-bodies 2*a* and 2*b* are inserted for free swinging within arching inner wall 70 of swingarm 4.

In FIGS. 8 and 9, there is clearly shown the condition in which swingarm 4 is axially supported by body 2. Specifically, arching inner wall 70 of swingarm 4 is axially supported for free swinging by first axle sockets 30*a* and 30*b* of half-bodies 2*a* and 2*b*. Furthermore, axle socket 30*b* appears in FIG. 8, and first axle socket 30*a* appears in FIG. 9. In addition, sleeve 146 is inserted and fixed at the inner side of unified first axle sockets 30*a* and 30*b*. Sleeve 146 possesses annular recess 147 at both sides (FIGS. 1 and 2). Additionally, annular step 148 is formed at the outer peripheral edge of respective openings 24*a* and 24*b* of half-bodies 2*a* and 2*b*, as shown in FIG. 3(*a*) and FIG. 13. When sleeve 146 is inserted into first axle sockets 30*a* and 30*b*, annular recess 147 of sleeve 146 is mated to annular step 148, and along with fixing of sleeve 146 within axle first sockets 30*a* and 30*b*, it supports half-bodies 2*a* and 2*b* in a manner that half-bodies 2*a* and 2*b* will not be separated.

This section describes the positional relationship between mating hook 8*b* and protrusion 74 of swingarm 4 within swing-mount 6. FIG. 12 is a cross-sectional perspective drawing showing swing-mount 6 and related vicinity at time when swingarm 4 is in closed condition. Mating hook 8*b* is positioned in the edge vicinity of annular wall 26*c*,and protrusion 112 of mating hook 8*b* is positioned in the edge vicinity of the inner side of annular wall 26*c* of swingarm 4. Therefore, protrusion 74 formed below the edge of annular wall 26*c* is positioned as separated downwards from mating hook 8*b*.

As shown in FIGS. 8 and 9, previously described pipe assembly 20 is disposed within protective cover 60 of swingarm 4, and extension 86 is positioned at swing-mount 6 after passage through opening 66 of swingarm 4. Therefore, protrusion 88 of extension 86 is positioned at one end of stopping sections 40*a* and 40*b*, and is mated to stopping sections 40*a* and 40*b*, specifically mating section 40. At the time of this condition, even at attempt to pull tip tube 20*a* outward, it cannot be withdrawn due to protrusion 88 being mated to mating section 40, and it maintains a compact condition. Moreover, only stopping section 40*b* is visible with FIG. 8, but stopping section 40*a* is positioned identically at the forward side. At this time, protrusion 88 is positioned between stopping sections 40*a* and 40*b*. In this condition, pipe assembly 20 is not protruding to the outside from protective cover 60 at the opposite end but is in a condition withdrawn into protective cover 60.

This section further describes lighter 1 by referencing FIG. 9. At housing 104 in which is installed fuel tank 106, connector 118 is installed and connected to gas pipe 96 for supplying fuel to gas pipe 96. Gas pipe 96 passes through swing-mount 6 and reaches pipe assembly 20. Lever (swing preventer) 120 is disposed in a position corresponding to notch 8*d* of operating button 8. The following describes this lever 120 by additionally referencing FIGS. 11 and 13. FIG. 11(*a*) is a perspective drawing, FIG. 11(*b*) is a top view drawing, FIG. 11(*c*) is a right side view drawing, FIG. 11(*d*) is a front view drawing, and FIG. 11(*e*) is a bottom view drawing. In addition, FIG. 13 is a cross-sectional perspective drawing showing swing-mount 6 and the related vicinity.

Lever 120 is of a roughly flat and long shape, and cylindrical spindle 120*a* is disposed projecting in a sideways direction at side edge 124*a* in the vicinity of one end. As shown in FIG. 11(*a*), the section extending toward the side of operating button 8 from spindle 120*a* is named first arm 121, and the section extending toward swing-mount 6 is named second arm 123. In addition, at upper surface 126 and lower surface 128 of lever 120, curved protrusion 120*c* is formed having joint position with spindle 120*a*. Moreover, at second arm 123, rectangular flange 120*b* is disposed projecting toward the side on the opposite side of spindle 120*a* and at the lower surface 128 of side edge 124*b*. On first arm 121 is formed rectangular plate 120*d* which is larger than rectangular flange 120*b*. Lever 120 is axially supported by spindle 120*a* in axle socket 122 (FIG. 3(*b*)), having rectangular plate 120*d* at the side toward operating button 8. It is then supported by compression coil spring (hereafter, simply referred to as spring) 130 disposed at the half-body 2*a* side. In the lighter 1 assembled condition, notch 8*d* of operating button 8 is mated to rectangular plate 120*d* of first arm 121. Leading edge 120*e* of second arm 123 incorporating rectangular flange 120*b* is mated to slot 78 of arching inner wall 70 of swingarm 4.

This section describes the condition at utilization of lighter 1 structured in this way by reference to FIGS. 14 and 15. FIG. 14 is a vertical cross-section drawing similar to FIG. 6 and showing a condition in which swingarm 4 of lighter 1 is partially opened. FIG. 15 is a main component enlarged cross section drawing showing swing-mount 6, operating button 8 and the related vicinity. Referencing FIG. 15, when swingarm 4 is swung for opening, protrusion 88 of pipe assembly 20 separates from mating section 40 and swings clockwise per FIG. 14. This swingarm 4 position is a condition at which swingarm 4 has been opened from the closed position. When in this condition, if there is by such as application of external force inadvertent swinging of swingarm 4 in the direction for closing while a foreign object 134 such as a finger is positioned between operating button 8 and swingarm 4, it will result in pressing of operating button 8 downward as shown by arrow 136.

At this time, lever 120 mated with operating button 8 swings counterclockwise per FIG. 14. As shown in detail in FIG. 15, leading edge 120*e* of lever 120 is mated to slot 78 of arching inner wall 70 of swingarm 4. Then, at pressing of operating button 8 downward by further action of swingarm 4, operating button 8 presses further downward rectangular plate 120*d* of lever 120. The result is that leading edge 120*e* of lever 120 biases upward rib 76 formed with adjacent contact above slot 78. In this way, protective cover 60 of swingarm 4 is prevented from shifting further downward. At this time, operating button 8 enters a condition in which it is hard to press due to resistance of lever 120. In this condition, arm 8*e* of operating button 8 is pressing sliding component 102*a* of piezoelectric unit 102 to an extent but not reaching the ignition point.

The following describes the positional relationship between mating hook 8*b* of operating button 8 disposed at the opposite side of lever 120 and protrusion 74 formed on annular wall 26*c* of swingarm 4 by referencing FIG. 16. FIG. 16 is a cross-section drawing similar to FIG. 8 and showing a lighter 1 cross-section for a position differing from that of FIG. 14, with FIG. 16(*a*) being a cross-section of lighter 1 in a condition identical to that of FIG. 14, and FIG. 16(*b*) being a main component cross-section showing the condition when operating button 8 is further pressed. As shown in FIG. 16(*a*), protrusion 74 is positioned in the vicinity of mating hook 8*b*, but it has not reached the point of mating with mating hook 8*b*. By pressing operating button 8, arm 8*e* of operating button 8 slightly presses sliding component 102*a*.

In this condition, when swingarm 4 is pressed further downward, along with swingarm 4 opening in the counterclockwise direction per FIG. 16(*b*), as previously described, mating hook 8*b* of operating button 8 mates to protrusion 74. Specifically, protrusion 74 is inserted between protrusion 112 of mating hook 8*b* and annular wall 26*c*. At this time, arm 8*e* of operating button 8 presses further on sliding component 102*a*, but not to the point of ignition. In order to ignite, shaft 8*c* of operating button 8 must shift within second axle socket 50 to the right, and sliding component 102*a* must be further pressed by the shifting of operating button 8. However, protrusion 112 of mating hook 8*b* will not allow shifting because it is mated to protrusion 74. In this way, a locking structure is formed by mating hook 8*b* and protrusion 74. Accordingly, when swingarm 4 is slightly opened, there is prevention of inadvertent ignition from pressing of operating button 8 by interposition by swingarm 4 of foreign object 134 such as a finger between swingarm 4 and body 2.

This section describes the condition when swingarm 4 is further opened by referencing FIG. 17. FIG. 17 is a partial cross-section drawing showing the condition in which swingarm 4 is opened at an approximate right angle. In this condition, swelled previously described protrusions 73 of protrusion sections 72*a* and 72*b* are respectively mated to notches 30*d* and 30*e*, the position of swingarm 4 is maintained in the condition, and protrusion 74 is separated from mating hook 8*b*. Accordingly, it is possible to consider attempting ignition by pressing operating button 8, but ignition is not normally performed in this position. Even in the event of inadvertent ignition, the flame emitted from flame port 82 of swingarm 4 will not blow near the hand holding body 2 and cause a burn. The important factor is that, with swingarm 4 in this position, previously described protrusion 88 of pipe assembly 20 is at a point contacting stopper 41 of body 2. Accordingly, if further opening is caused by swinging swingarm 4 in the counterclockwise direction, pipe assembly 20 within protective cover 60 will start sliding to cause protruding of pipe assembly 20 from protective cover 60 because protrusion 88 is mated against stopper 41.

With such established, this section describes the condition in which swingarm 4 is further opened by referencing FIGS. 18 and 19. FIG. 18 is a vertical cross-section drawing of lighter 1 showing the condition in which swingarm 4 has been opened approximately 150 degrees, and FIG. 19 is a vertical cross-section drawing of lighter 1 showing a cross-section of a position that differs from that of FIG. 18. As shown in FIGS. 18 and 19, with protrusion 88 of pipe assembly 20 in contact with stopper 41, because swingarm 4 will be swung, tip tube 20*a* which will become the nozzle tip 94*a* edge of pipe assembly 20 enters a condition in which it has protruded from exposure port 60*b* of protective cover 60 (FIG. 6(*a*)). In this condition, at time of ignition, even if tip tube 20*a* contacts an external foreign object such as gas equipment not shown in the drawing, because protrusion 88 of pipe assembly 20 is in contact against stopper 41, tip tube 20*a* will not be forced into protective cover 60. Accordingly, there is little danger that the flame emitted from flame port 82 will be applied to protective cover 60. As shown in FIG. 18, the lower edge of notch 8*d* of operating button 8 contacts against protrusion 46*a* of body 2 and prevents swinging beyond this point. In FIG. 19, the shift amount of sliding component 102*a* does not attain the sliding amount required to generate voltage.

When horizontally shifting operating button 8 to the right from this condition as shown by arrow 138 in FIG. 20, there can be obtained the prescribed sliding component 102*a* sliding amount required for ignition. FIG. 20 is a component enlarged cross-section drawing showing the condition when operating button 8 has been caused to slide. As shown in FIG. 20, by sliding operation of operating button 8, arm 8*e* presses sliding component 102*a* of piezoelectric unit 102 for a prescribed distance d, and piezoelectric unit 102 generates electricity. This enables causing of an electric discharge in the vicinity of nozzle tip 94*a*. If there is an attempt to close body 2 by swinging clockwise per FIG. 20 swingarm 4 that is emitting a flame, protrusion 74 of swingarm 4 will mate with protrusion 112 of mating hook 8*b* and generate resistance, preventing closing to less than a prescribed angle. Accordingly, it is possible to prevent such as burns to the hand holding body 2 and scorching of clothing.

In addition, operation of the fuel supply valve is linked to shifting of sliding component 102*a*. This fuel supply valve operation is described by referencing FIG. 21. FIG. 21 is a cross-section drawing along line 21-21 of FIG. 8 and shows the operating condition of the fuel supply valve, with FIG. 21(*a*) showing the condition prior to ignition operation, and with FIG. 21(*b*) being a component cross-section drawing showing the condition after ignition operation. Sliding component 102*a* is positioned at the side of the fuel supply valve, and it possesses lever depressor 102*b* integrally formed with sliding component 102*a* along the sliding direction of sliding component 102*a*. This lever depressor 102*b* shifts with the shifting of sliding component 102*a*. Additionally, fuel supply valve 142 is disposed at housing 104. Mated to this fuel supply valve 142 is approximately L-shaped lever 144 axially supported for free oscillation to shaft 145 within the space shown. Lever 144 possesses mating arm 144*a* mated to fuel supply valve 142 and drive arm 144*b* positioned in the vicinity of lever depressor 102*b*.

In the condition in which sliding component 102*a* of piezoelectric unit 102 is not being pressed to the right per FIG. 21, drive arm 144*b* protrudes within the pathway of level depressor 102*b*. When sliding component 102*a* is pressed by arm 8*e* of operating button 8, drive arm 144*b* is pressed by level depressor 102*b* and moves clockwise per FIG. 21. This swings mating arm 144*a* clockwise, shifts fuel supply valve 142 to the right, and enables emitting of gas. Gas emitted from fuel supply valve 142 is conducted through gas pipe 96 to nozzle 94. In addition, power line 140 (FIG. 8) is routed from piezoelectric unit 102 to nozzle 94 and the vicinity of nozzle tip 94*a* of tip tube 20*a*, and it releases an electric discharge to ignite the gas emitted from nozzle tip 94*a*. These structural components are widely known and therefore a detailed description is omitted.

LEGEND

Figure 1:
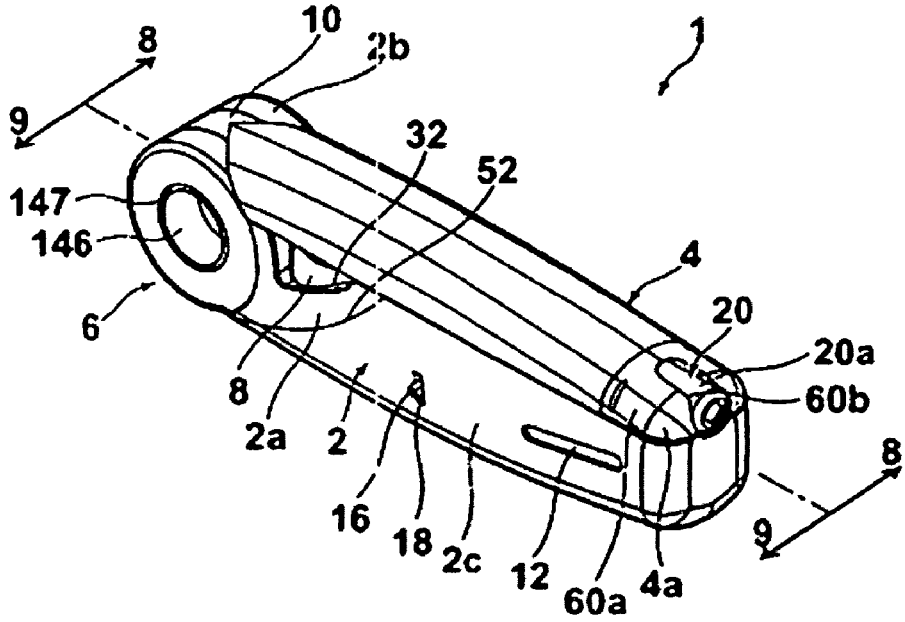
FIG. 1 is a perspective drawing showing the folded condition of the folding lighter being one example of this invention.
Figure 2:
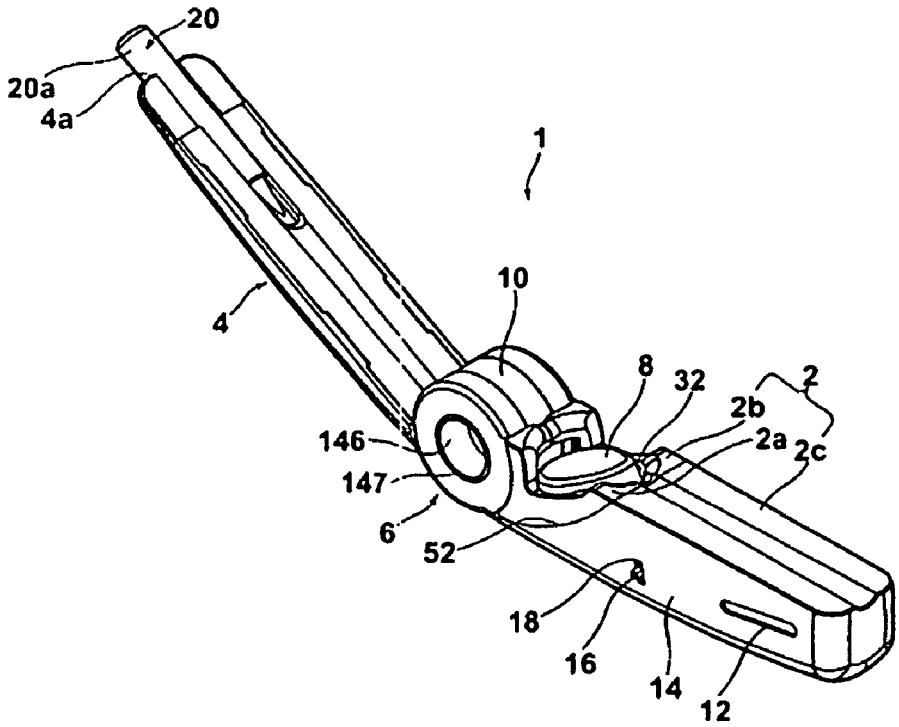
FIG. 2 is a perspective drawing showing the folding lighter of FIG. 1 is a condition opened and capable of utilization.
Figure 3:
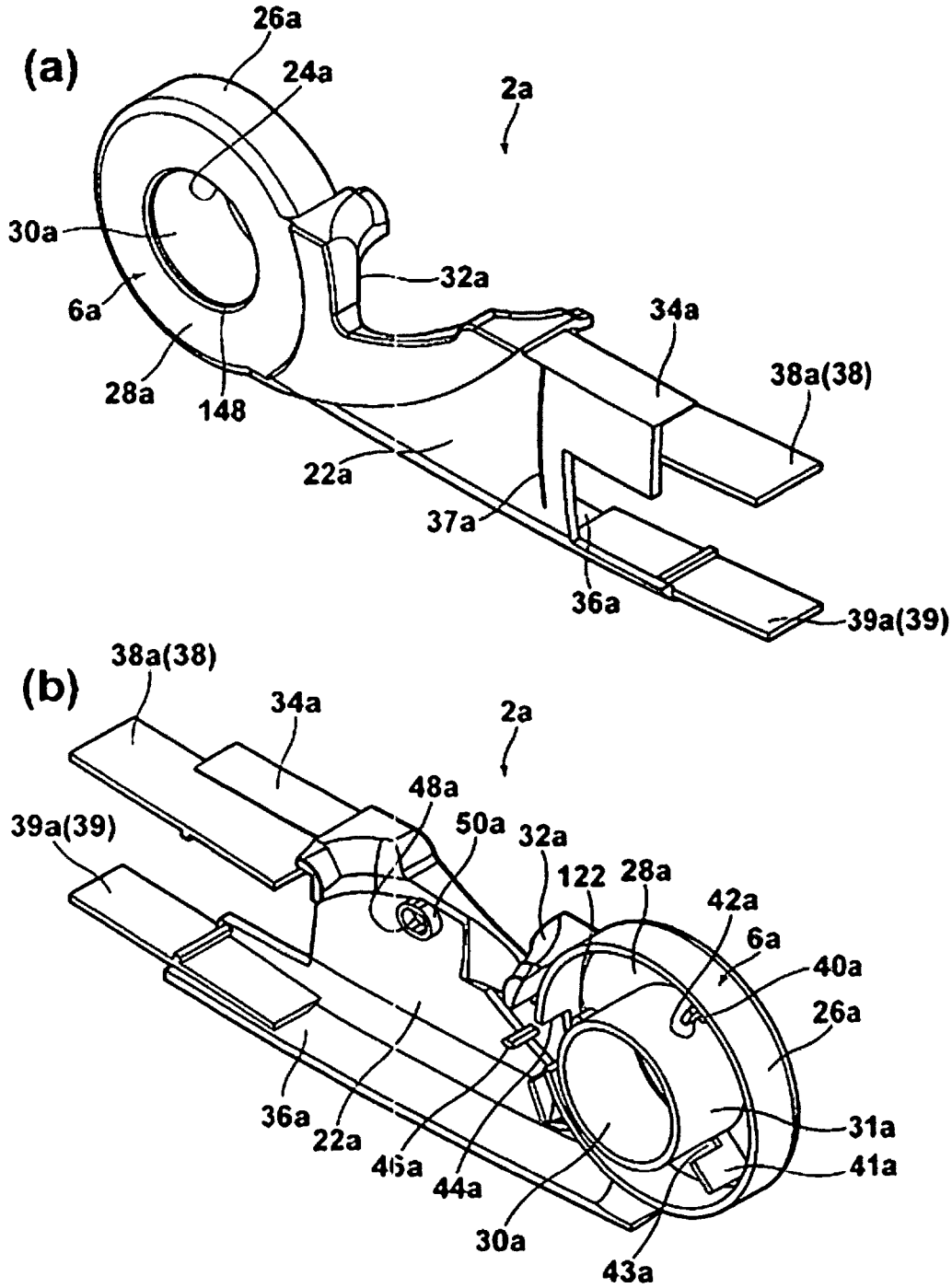
FIG. 3 is a perspective drawing showing the forward side half-body of FIGS. 1 and 2, with (*a*) showing the half-body as seen from the outer side and (*b*) showing the half-body as seen from the inner side.
Figure 4:
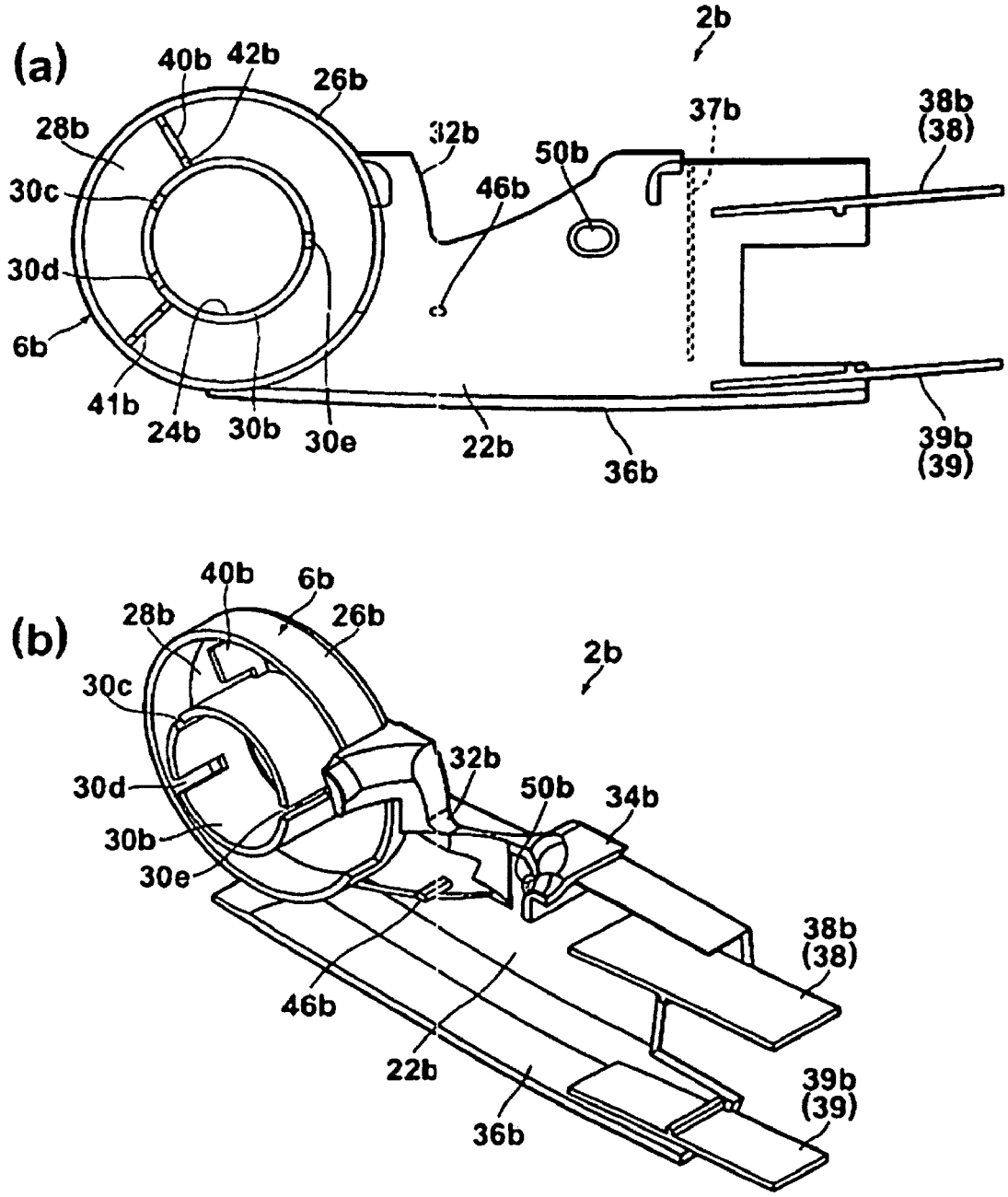
FIG. 4 shows the opposite side half-body from that of FIG. 3, with (*a*) being a front view drawing as seen from the inner side and (*b*) being a perspective as seen from the inner side.
Figure 5:
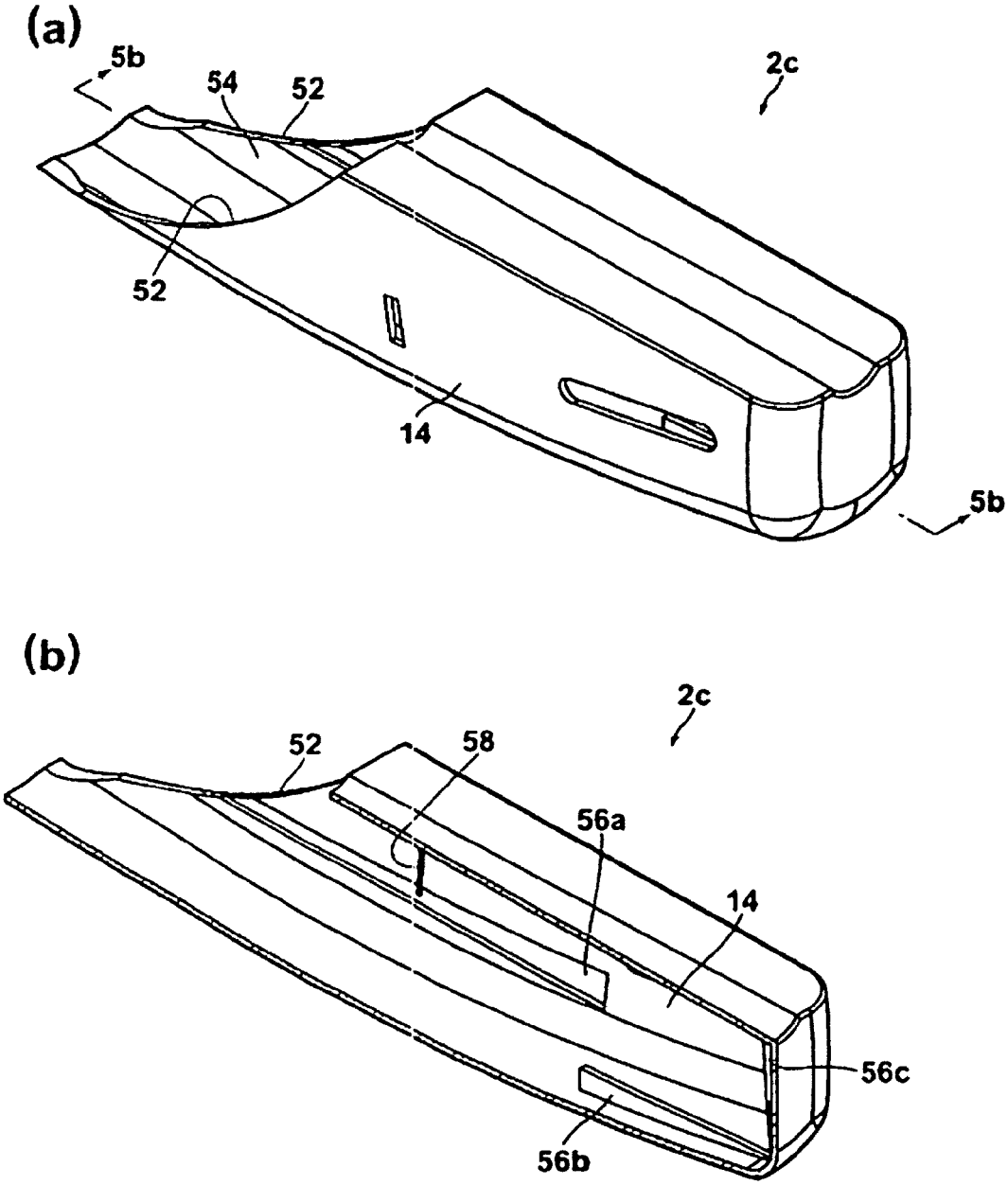
FIG. 5 shows the full-body cover, with (*a*) being a perspective drawing and (*b*) being a perspective drawing showing the cross-section along line 5*b*-5*b* of FIG. 5(*a*).
Figure 6:
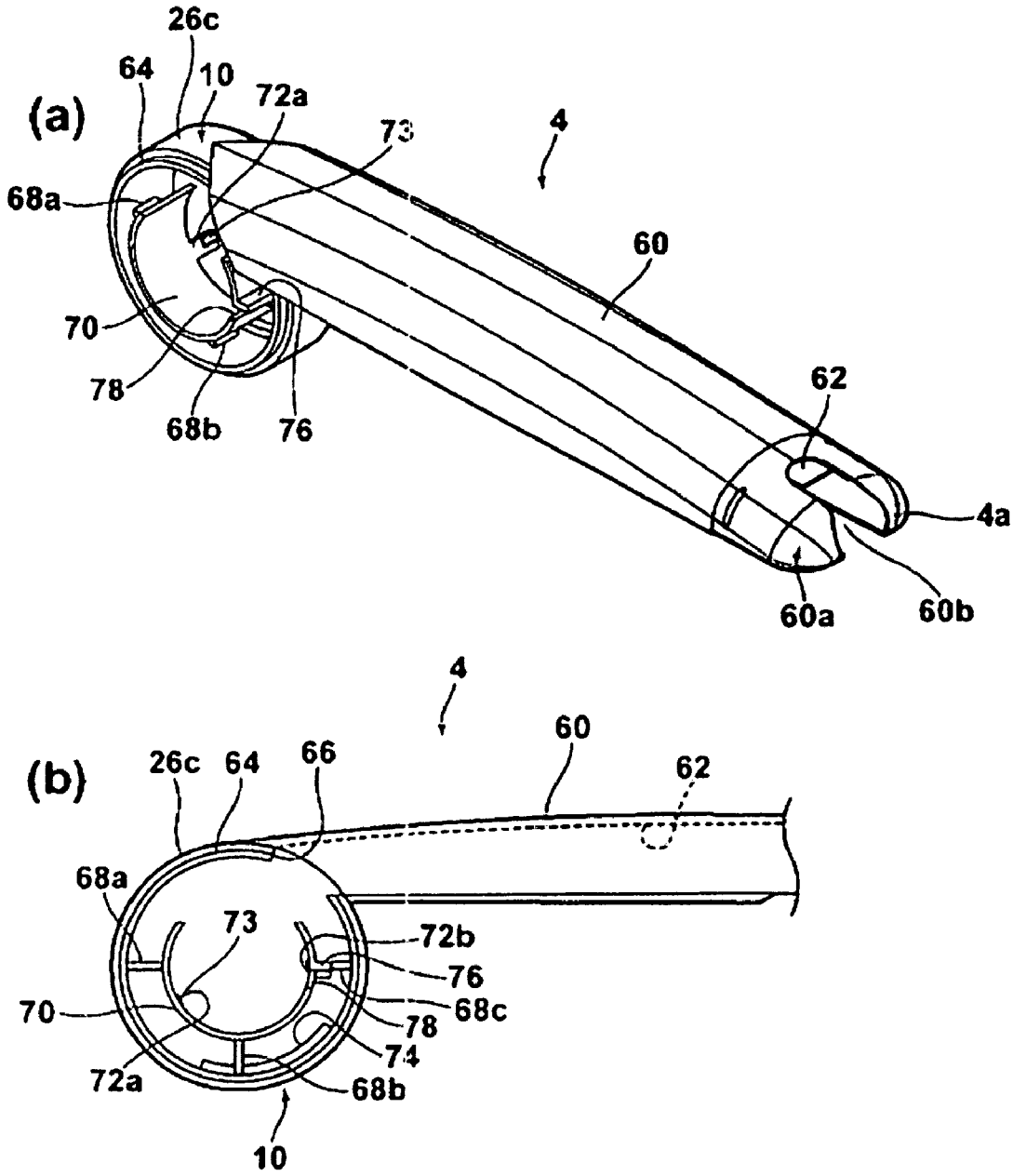
FIG. 6 shows the swingarm, with (*a*) being a perspective drawing and (*b*) being a front view drawing.
Figure 7:
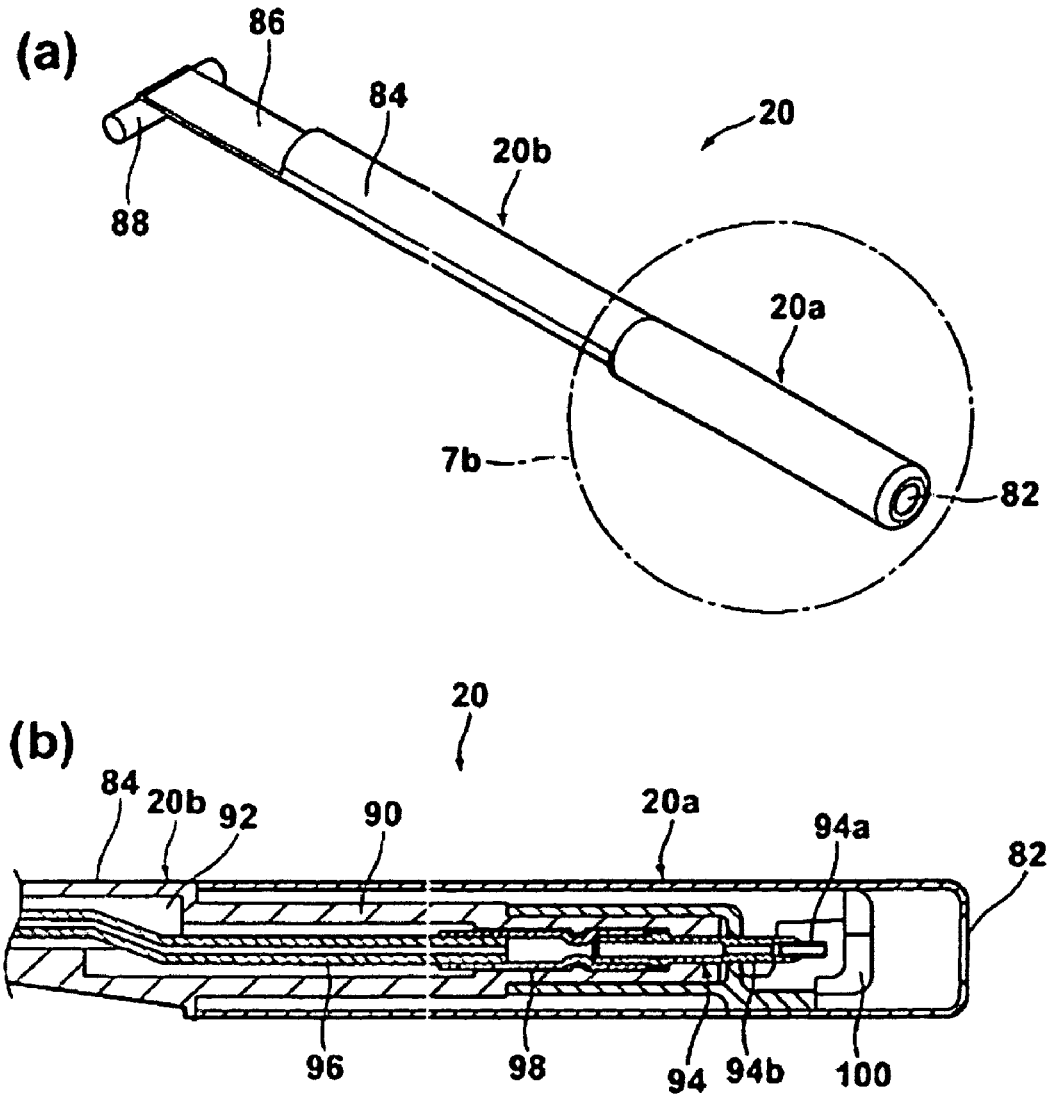
FIG. 7 shows the pipe assembly, with (*a*) being a perspective drawing and (*b*) being a component cross-section drawing of the region shown by circle 7*b* in FIG. 7(*a*) and showing the nozzle and gas pipe within the pipe assembly for the folded condition.
Figure 8:
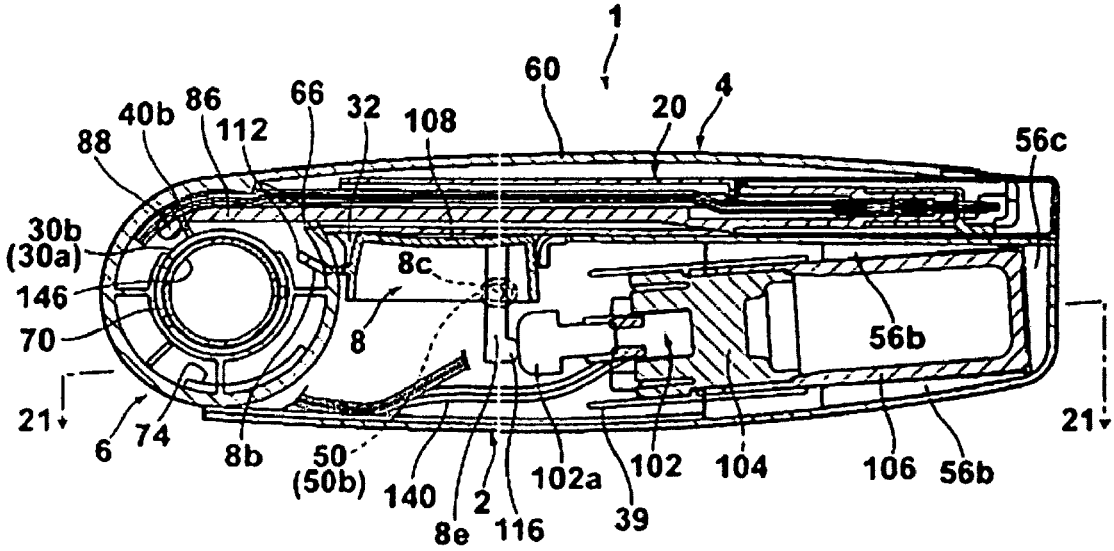
FIG. 8 is a cross-section along line 8-8 of the folding lighter shown in FIG. 1.
Figure 9:
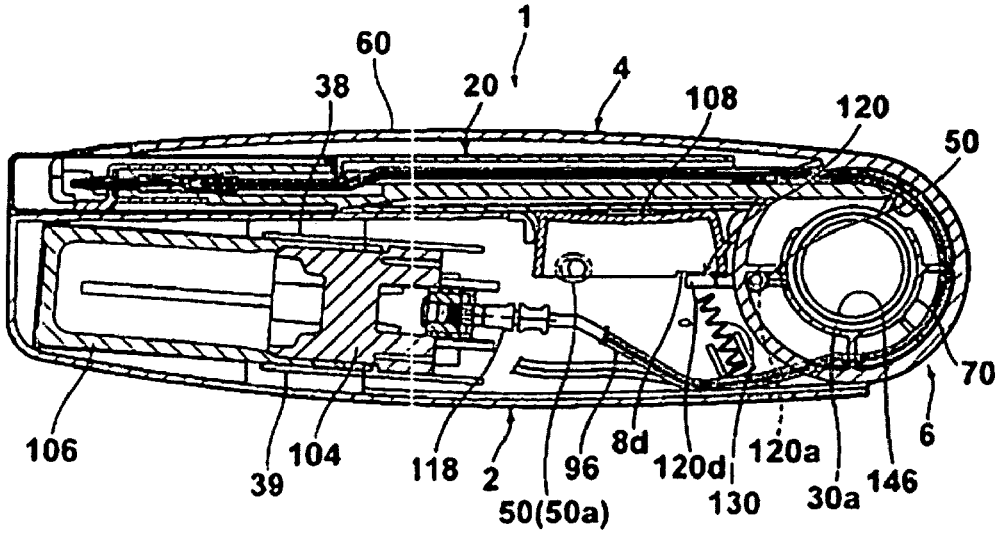
FIG. 9 is a cross-section along line 9-9 of the folding lighter shown in FIG. 1.
Figure 10:
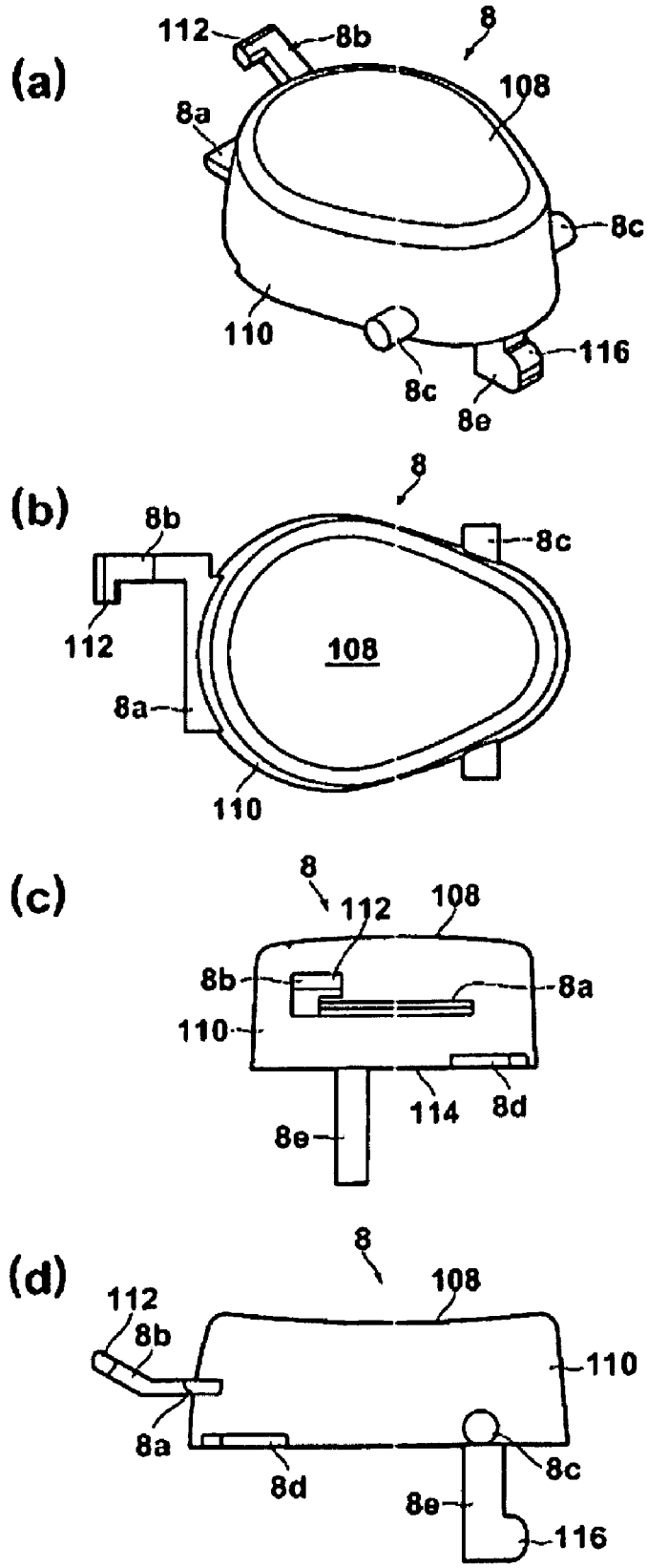
FIG. 10 shows the operating button, with (*a*) being a perspective drawing, (*b*) a top view drawing, (*c*) a side view drawing, and (*d*) a front view drawing.
Figure 11:
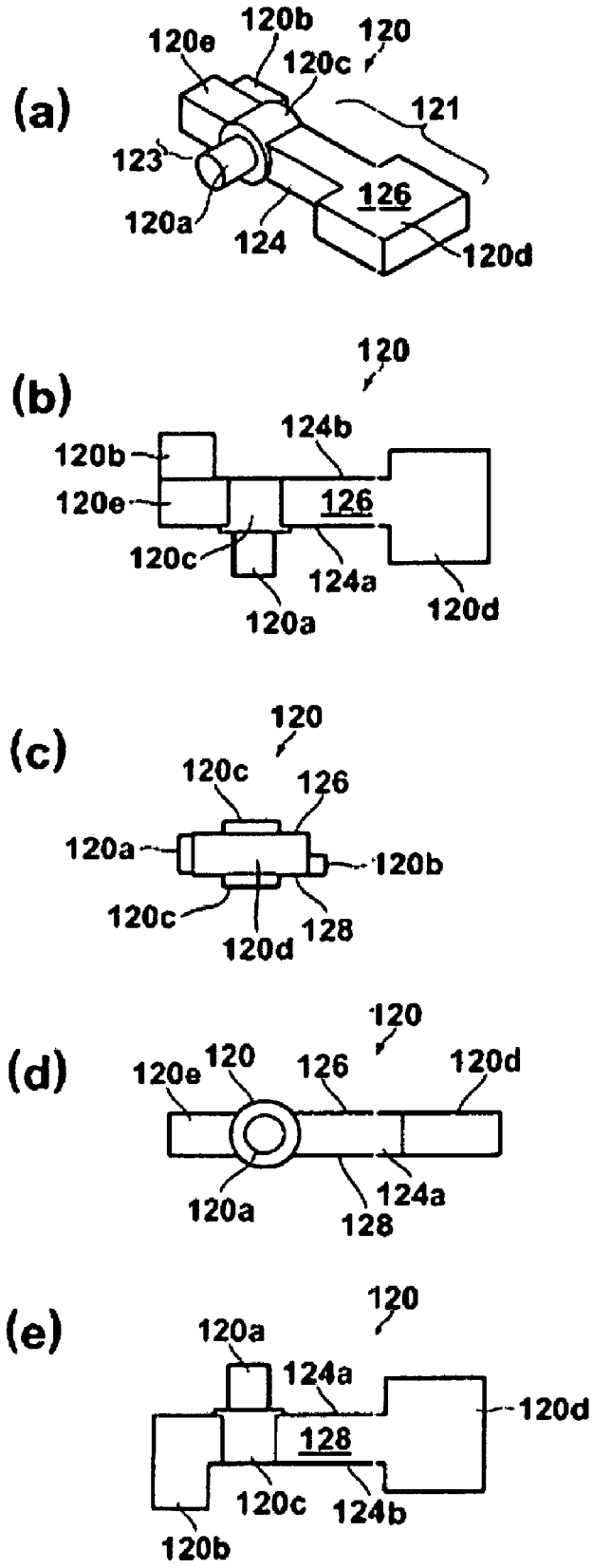
FIG. 11 shows the lever, with (*a*) being a perspective drawing, (*b*) top view drawing, (*c*) a right side view drawing, (*d*) a front view drawing, and (*e*) a bottom view drawing.
Figure 12:
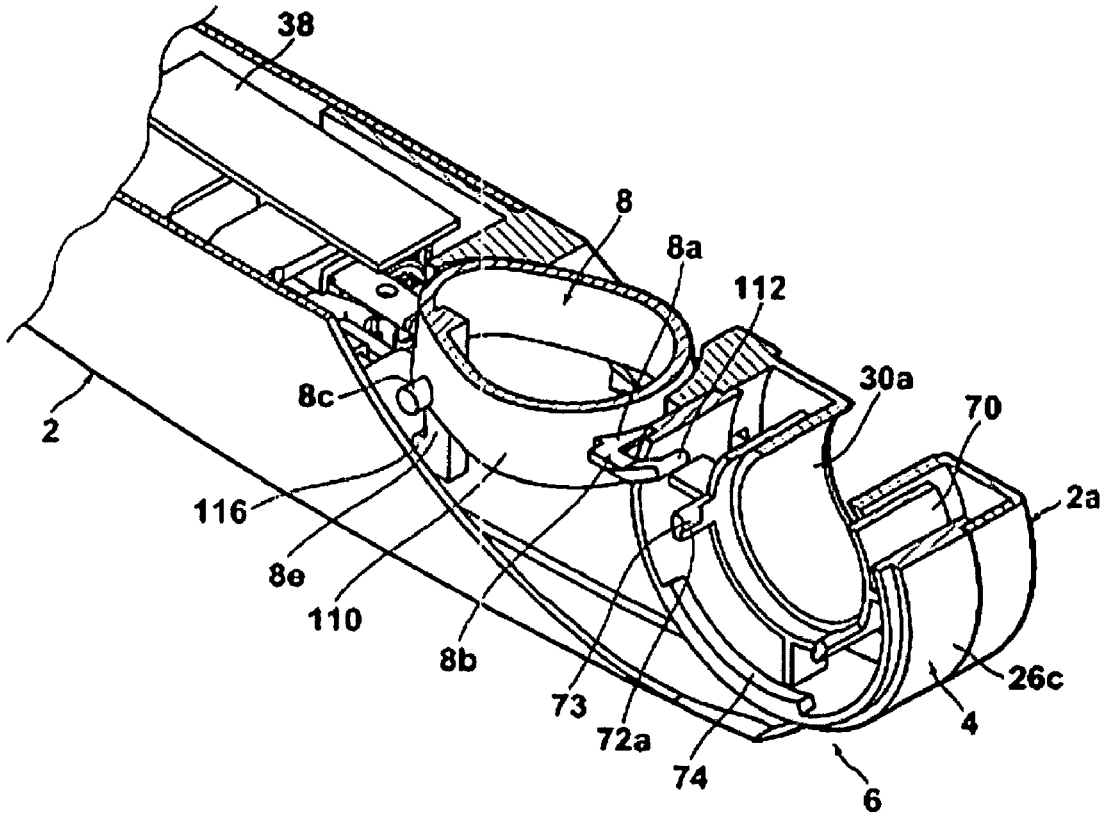
FIG. 12 is a component cross-sectional perspective drawing showing the swing-mount and related vicinity in condition when the swingarm is closed.
Figure 13:
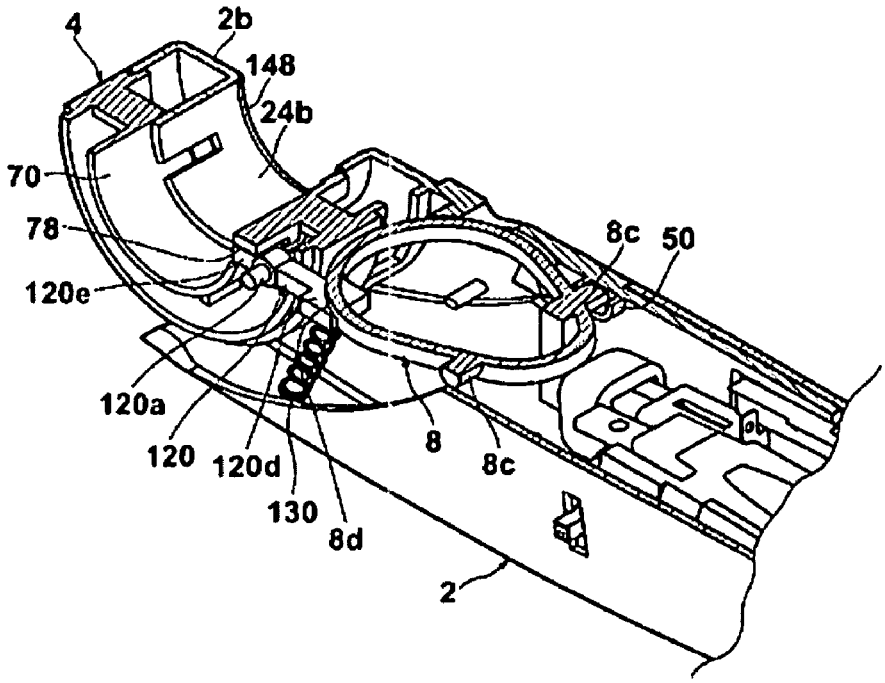
FIG. 13 is a component cross-sectional perspective drawing showing the swing-mount and related vicinity.
Figure 14:
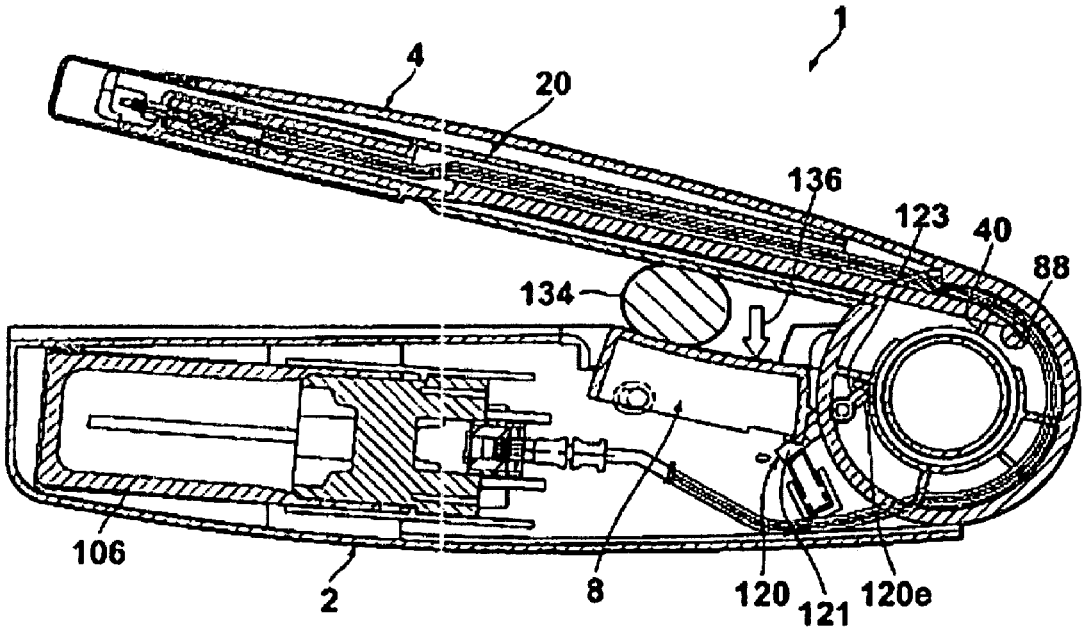
FIG. 14 is a vertical cross-section drawing similar to FIG. 6 and showing the condition in which the swingarm of the folding lighter is slightly opened.
Figure 15:
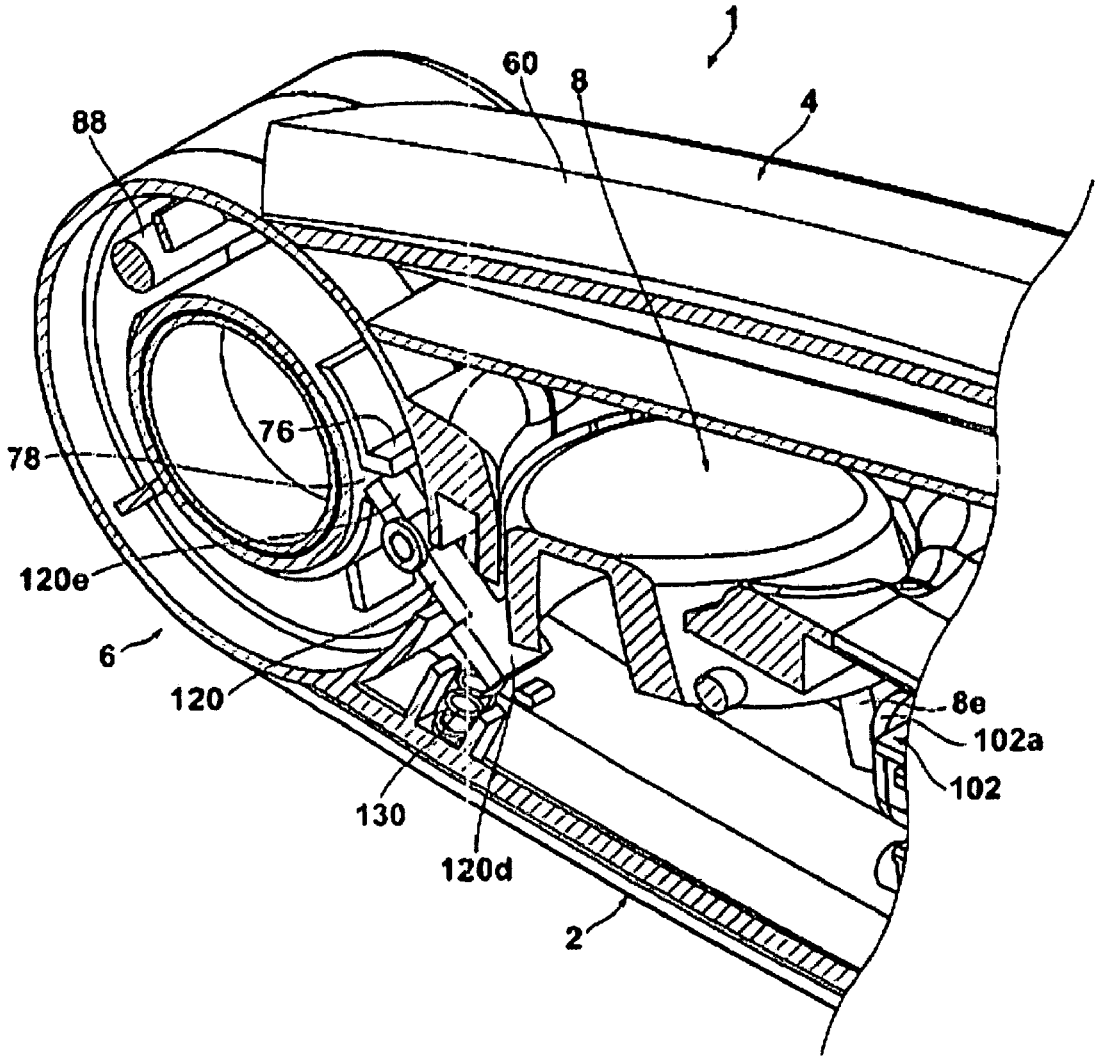
FIG. 15 is a main component enlarged cross-section drawing showing the swing-mount, operating button and the related vicinity.
Figure 16:
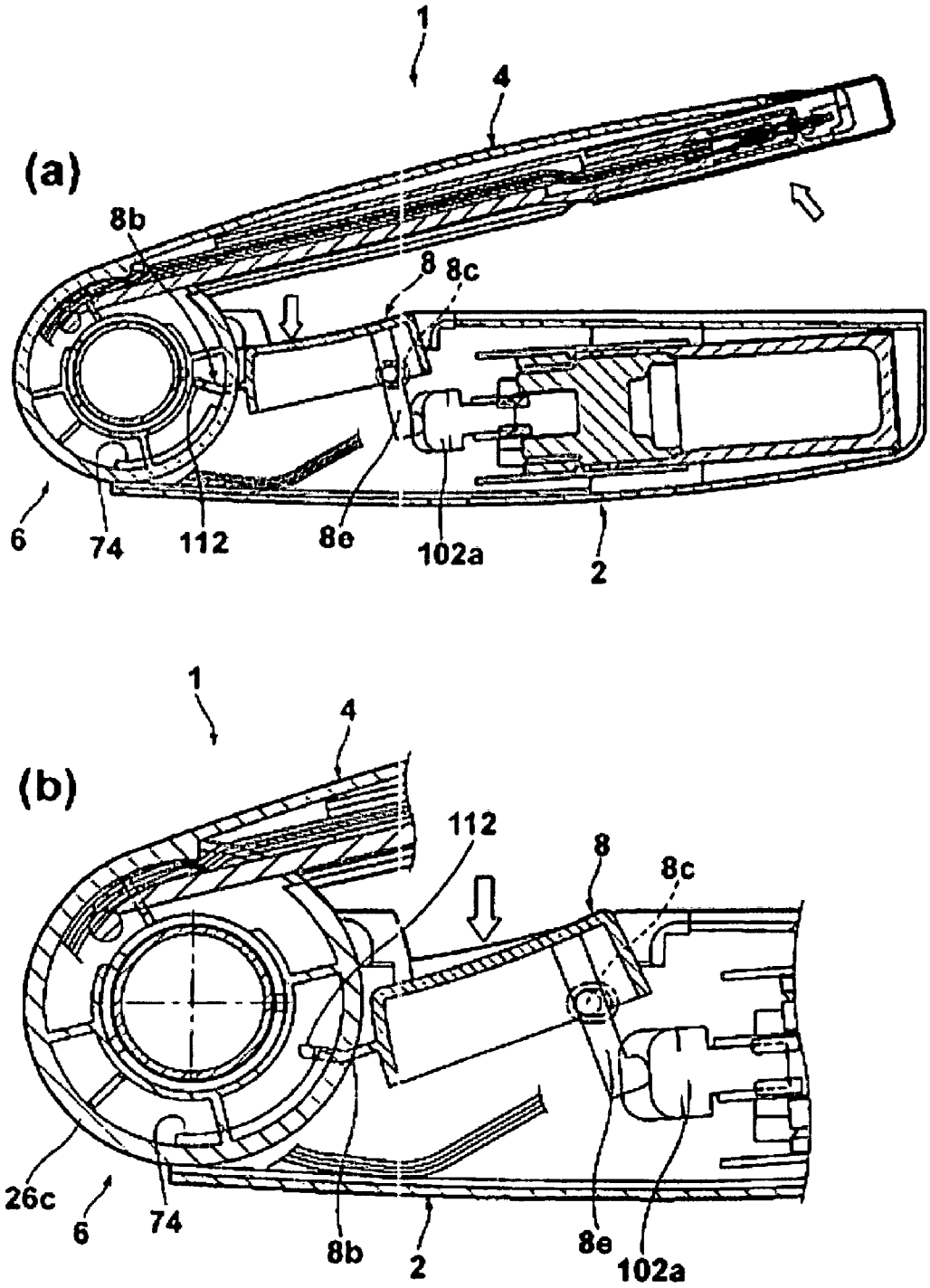
FIG. 16 is a cross-section drawing similar to FIG. 8 and showing a cross-section of the folding lighter for a position differing from that of FIG. 14, with (*a*) being a cross-section of the folding lighter in a condition identical to that of FIG. 14 and (*b*) being a main component cross-section drawing showing the condition when the operating button is being further pressed.
Figure 17:
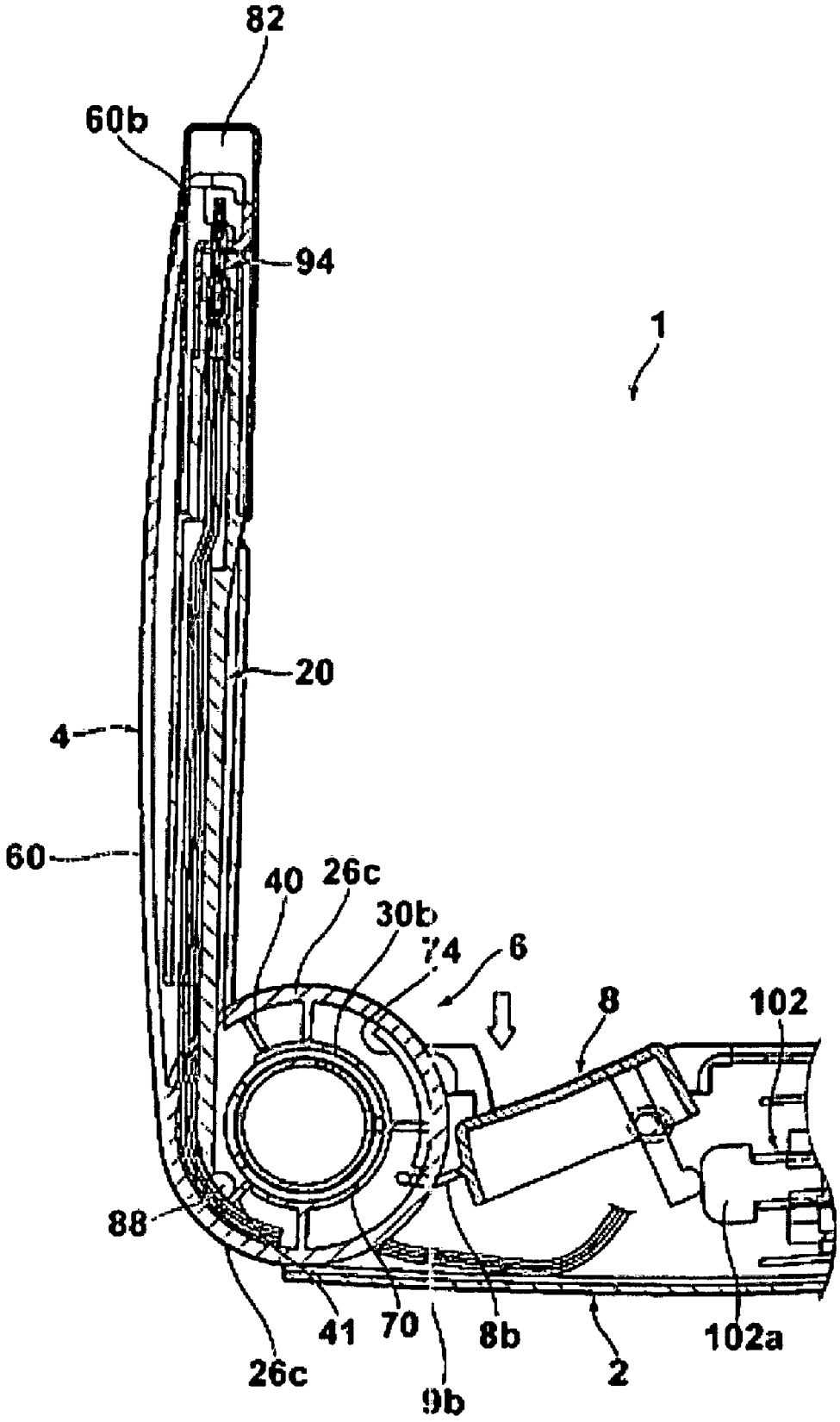
FIG. 17 is a component cross-section drawing showing the condition in which the swingarm has been opened to approximately a right angle.
Figure 18:
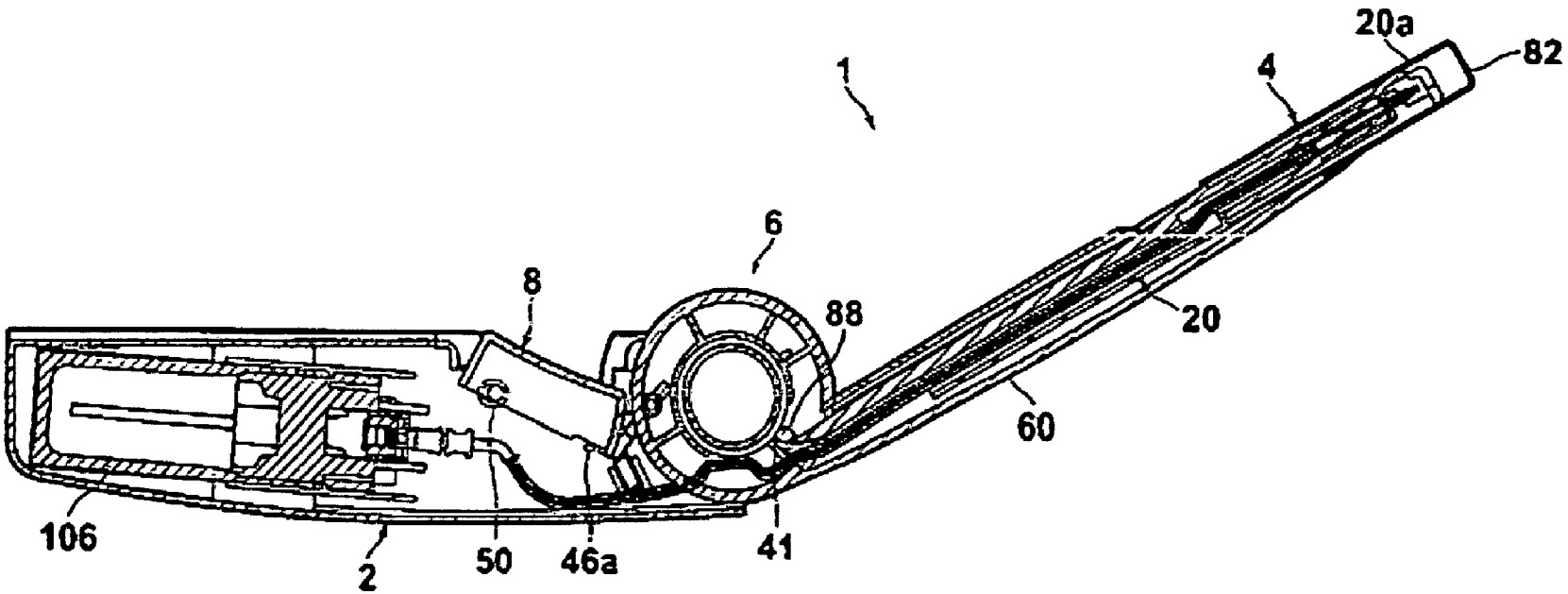
FIG. 18 is a vertical cross-section drawing of the folding lighter showing the condition in which the swingarm has been opened to approximately 150 degrees.
Figure 19:
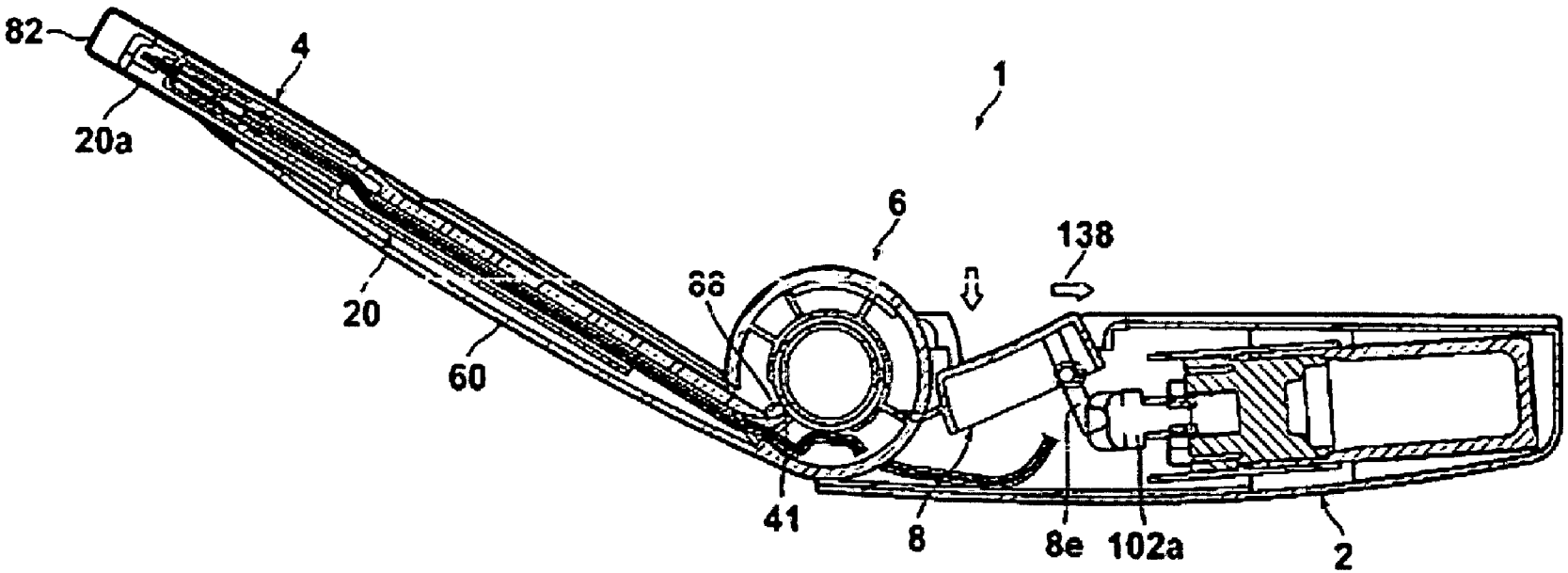
FIG. 19 is a vertical cross-section drawing of the folding lighter showing a cross-section for a position differing from that of FIG. 18.
Figure 20:
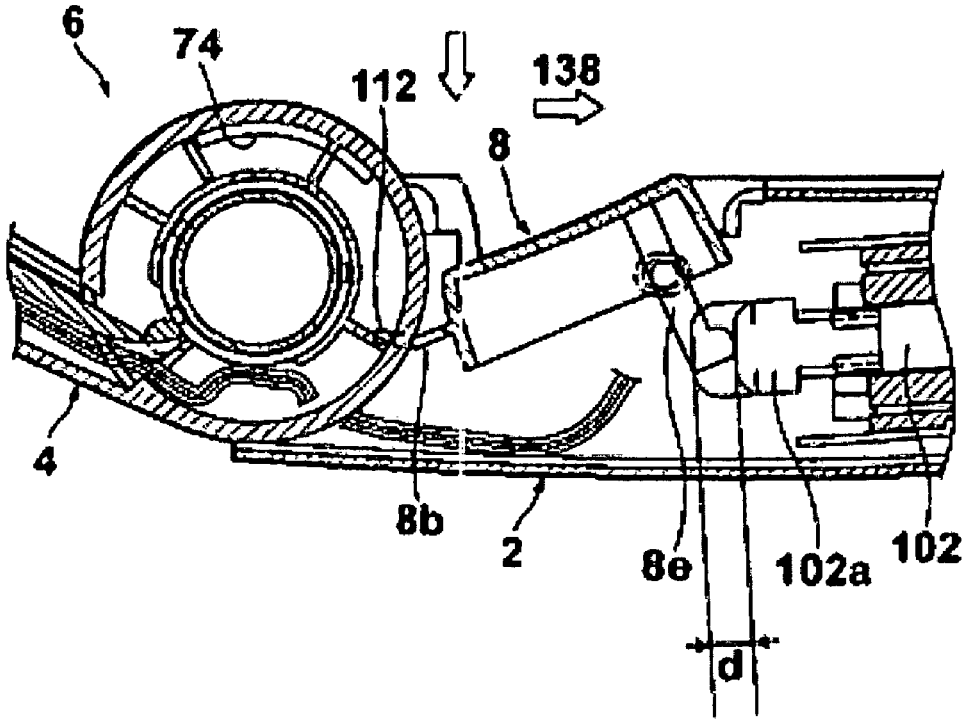
FIG. 20 is a main component enlarged cross-section drawing showing the condition at time when the operating button has been caused to slide.
Figure 21:
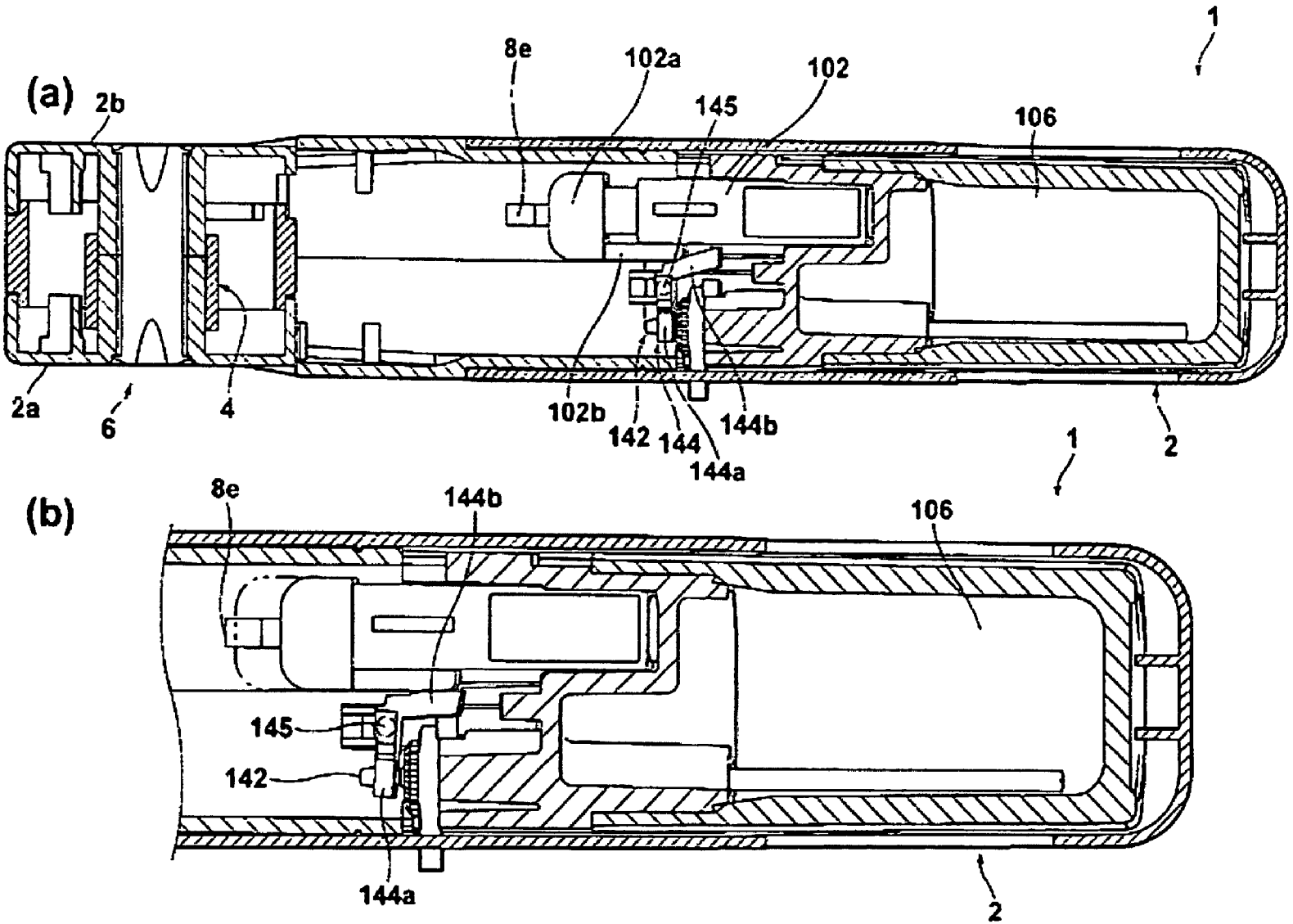
FIG. 21 is a cross-section drawing along line 21-21 of FIG. 8 and showing the operating condition of the fuel supply valve, with (*a*) showing the condition prior to the ignition operation and (*b*) being a component cross-section drawing showing the condition after the ignition operation.

1 Folding Lighter
2 Body
4 Swingarm
8 Operating Button (Operating Component)
20 Pipe Assembly
26*a*, 26*b*, 26*c* Annular Wall (Cylindrical Wall)
30*a*, 30*b* Axle Socket (Inner Cylinder)
40 Mating Section
41 Stopper
60*b* Exposure Port
70 Arching Inner Wall (Outer Cylinder)
88 Protrusion
94 Nozzle (Flame Emitting Nozzle)
96 Gas Pipe (Flexible Fuel Conduit)
102 Lever (Swing Preventer)
122 Axle Socket
134 Foreign Body
142 Fuel Supply Valve While the foregoing describes the present invention in relation to illustrations and examples, it is understood that it is not intended to limit the scope of the invention to the illustrations and examples described herein. On the contrary, it is intended to cover all alternative modifications and equivalents that may be included in the spirit and the scope of the invention as defined by the appended claims.

What is claimed is:

1. A folding lighter that is a folding lighter comprising a body that houses a fuel tank and a piezoelectric unit, and possesses at the side surface an operating component exposed to the outside for operating with approximate contemporaneousness said piezoelectric unit and a fuel supply valve that controls supply of fuel from said fuel tank, and a swingarm connected to one end of said body, and housing a flame emission nozzle in the vicinity of the opposite end, and opening and closing freely between a housing position being folded against said side surface of said body and a utilizing position being opened at 90 degrees or more from said body, and housing in said body and said swingarm a flexible fuel conduit connected at one end to said fuel tank and connected at the opposite end to said flame emission nozzle, and characterized by further possessing a safety mechanism for preventing folding of said swingarm when a foreign object such as a finger interposes between said swingarm and said operating component at time when said swingarm is being folded to said housing position, with said safety mechanism possessing a swing preventer axially supported by a first axle socket within said body and that rotates corresponding to operation of said operating component, and with said swing preventer possessing a first arm projected to a position that intervenes within the movement range of said operating component to be depressed by a pressing inward operation of said operating component, and possesses on the side opposite of said first axle socket a second arm that prevents said swingarm from being folded as a portion of said swingarm shifts within a range for shifting in response to folding movement of the swingarm, at a time when the first arm is pressed by the pressing inward operation of said operating component.

2. A folding lighter according to claim 1 further characterized by said second arm mating to said portion of said swingarm so as to push open said swingarm by the further pressing inward of said operating component, at time when said operating component is pressed further from a position preventing said swingarm from being folded.

* * * * *